United States Patent [19]

Wolf et al.

[11] Patent Number: 5,018,492

[45] Date of Patent: May 28, 1991

[54] WORK APPARATUS HAVING ONE HANDLE FOR ONE-HANDED OPERATION

[75] Inventors: Günter Wolf, Oppenweiler; Reinhold Fink, Fellbach, both of Fed. Rep. of Germany

[73] Assignee: Andreas Stihl, Waiblingen, Fed. Rep. of Germany

[21] Appl. No.: 601,234

[22] Filed: Oct. 22, 1990

[30] Foreign Application Priority Data

Oct. 24, 1989 [DE] Fed. Rep. of Germany ..... 3935361

[51] Int. Cl.[5] ..... F02F 7/00

[52] U.S. Cl. ..... 123/198 E; 30/381

[58] Field of Search ..... 123/41.7, 195 C, 198 E; 30/381

[56] References Cited

U.S. PATENT DOCUMENTS 4,936,271 6/1990 Nagashimo et al. ..... 123/198 E

*Primary Examiner*—Noah P. Kamen

*Attorney, Agent, or Firm*—Walter Ottesen

[57] ABSTRACT

The invention is directed to a work apparatus such as a motor-driven chain saw or the like and is especially directed to a one-hand chain saw. The apparatus has a housing for an engine for driving the work tool and an air/fuel-mixture is metered to the engine. The chain saw includes one handle for carrying and guiding the apparatus with the handle including a hold handle portion aligned approximately in the longitudinal axis of the chain saw and disposed above the housing. The handle also includes a bail-type side handle portion arranged at an angle toward the forward end of the hold handle portion. The hold handle portion is widened transversely to the longitudinal axis at its rearward end to permit the one-hand chain saw to be reliably held and guided. The carburetor is mounted in the receiving chamber so that the housing of the work apparatus can be smaller and thereby enable the hold handle portion to be brought closer to the gravity center of the chain saw. The wall of the receiving chamber facing the hold handle portion is configured as a bearing surface for the heel of the hand of the operator.

7 Claims, 3 Drawing Sheets

WORK APPARATUS HAVING ONE HANDLE FOR ONE-HANDED OPERATION

FIELD OF THE INVENTION

The invention relates to a work apparatus such as a motor-driven chain saw or the like for operation with one hand. The work apparatus has a housing for an engine for driving the work tool and an air/fuel-mixture is metered to the engine via a carburetor. One handle is provided for carrying and guiding the work apparatus.

BACKGROUND OF THE INVENTION

One-hand held chain saws of the kind described above are held and guided by the operator with one hand while the operator secures his hold with the other hand. If the center of gravity of the chain saw is significantly ahead of the throttle lever, then the acting forces produce a tilt movement of the saw chain in the forward direction which must be compensated for by the operator with an appropriate effort of the hand holding the chain saw in order that the chain saw can be held in a neutral position. This causes a considerable load on the holding hand; that is, on the wrist of the operator.

If the chain saw must be held inclined in an operating position, then it cannot be excluded that the upper handle portion rotates in the hand of the operator so that the operator has difficulty to hold the chain saw in the desired inclined position.

SUMMARY OF THE INVENTION

It is an object of the invention to provide a motor-driven chain saw which is improved so that it can be safely held by the operator without great effort.

The invention is directed to a work apparatus such as a chain saw or the like. The work apparatus is adapted to drive a work tool and to be manipulated by an operator holding the work apparatus with one hand. The work apparatus includes: a housing defining a longitudinal axis; an engine for driving the work tool and being mounted in the housing; a carburetor for metering an air/fuel-mixture to the engine; a handle unit for carrying and guiding the work apparatus, the handle unit including: a hold portion having a forward end disposed above the housing so as to extend approximately in the direction of the axis; and, a bail-type side portion extending at an angle from the forward end; a throttle lever movably journalled in the hold portion; the hold portion having a rearward end expanded transversely to the axis to form a wall defining a receiving chamber for accommodating the carburetor therein; and, the wall having a first wall portion facing toward the hold portion and the first wall portion being configured to define a bracing support for receiving the heel of the hand of the operator.

The arrangement of the carburetor in a receiving chamber of the handle housing affords the advantage that the size of the work apparatus can be limited so that the upper hold portion can be moved closer to the center of gravity of the work apparatus. The reduced spacing of the upper hold portion to the gravity center makes it possible for an operator to guide the work apparatus in a simple manner and with reduced effort.

The configuration of the outer wall of the receiving chamber as a bracing surface for the heel of the hand of the operator assures a reliable grip on the work apparatus. A rotation of the hold portion in the hand of the user is substantially avoided since torques occurring during operation can be braced against by the heel of the hand. Circular forces occurring when pivoting the work apparatus and which act against pivot movements can now be compensated by directing forces via the support surface so that the work apparatus according to the invention can be safely held by the user in unfavorable operating positions without great effort by the operator. Slippage of the hold portion of the handle unit relative to the holding hand is substantially eliminated because the heel of the hand is provided with a reliable surface in the longitudinal direction of the hold portion and also in the peripheral direction of this hold portion.

The handle unit is decoupled from the housing of the work apparatus via anti-vibration elements. In addition, the arrangement of the carburetor in the handle unit affords the advantage that motor vibrations are held away from the carburetor. Also, a heat transfer from the two-stroke engine to the carburetor is prevented so that the formation of vapor bubbles is substantially precluded. This is advantageous especially when starting a warm engine.

The receiving chamber is closed on all sides and is disposed at a spacing from the housing of the work apparatus. For this reason, the air disposed in the slot between the receiving chamber and the housing acts to effect an additional insulation which works to oppose a warming of the carburetor from the heat radiated by the engine.

The receiving chamber is advantageously configured from two housing parts conjointly defining a partition plane extending approximately diagonally through the receiving chamber. The first housing part is advantageously configured as one piece with the hold portion and the second housing part is configured as a removable cover. This configuration makes it possible to open the receiving chamber in such a manner that the carburetor is freely accessible for maintenance and repair work without making it necessary to open the housing of the engine. This is especially significant when exchanging the air filter for the combustion air.

The receiving chamber is advantageously provided with air inlet slits in its wall facing toward the housing so that the combustion air can be drawn in by suction through the slot between the receiving chamber and the housing of the work apparatus. In this way, large dirt particles are prevented from being drawn into the receiving chamber with the combustion air by suction. In addition, an improved thermal insulation is provided by the flow of air in the slot between the receiving chamber and the engine housing.

According to a further embodiment of the invention, the throttle lever is disposed approximately above the gravity center of the work apparatus equipped with a work tool so that the operator does not have to compensate for any tilt movement or the like in the neutral position of the work apparatus. The operator carries the work apparatus in the neutral position without having to develop any guiding forces.

A handle depression is provided in the housing beneath the hold portion in order to bring the position of the hold portion as close as possible to the center of gravity. The hold portion can be moved still further to the center of gravity without the danger of the throttle finger of the operator becoming jammed between the throttle lever and the engine housing whereby handling of the work apparatus according to the invention is still further improved.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
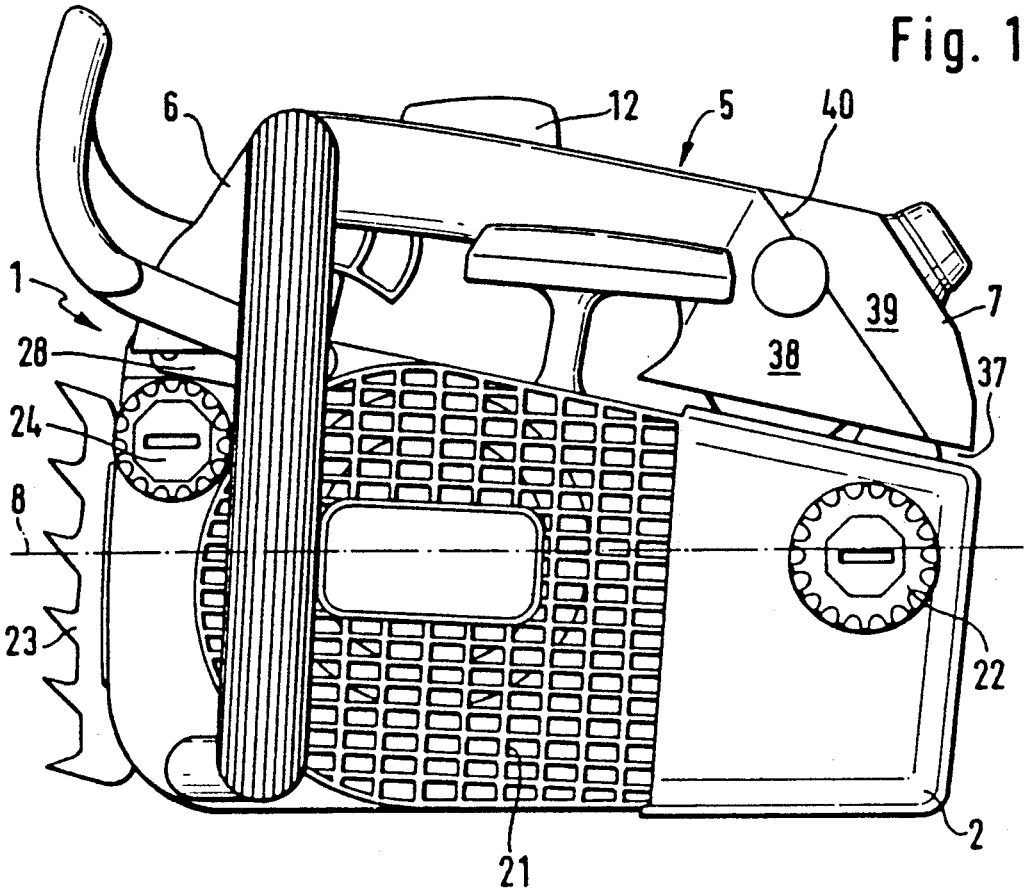
FIG. 1 is a side elevation view of the work apparatus according to the invention.

The work apparatus shown in FIG. 1 is a motor chain saw 1 having an internal combustion engine 3 (FIG. 2) arranged in a housing 2. The engine drives a work tool (not shown) which, in the case of a motor-driven chain saw, is a guide bar having a saw chain mounted thereon for movement around the periphery thereof. This work tool is fastened to the chain saw 1 at its forward end face and extends in the longitudinal direction of the chain saw. A toothed stop 23 is provided at the forward end face of the chain saw as shown.

A fan wheel as well as a manual starter 20 are arranged at the one longitudinal end of the chain saw. The fan wheel is covered by an air inlet screen 21. An oil reservoir for lubricating the saw chain on the guide bar is provided in the housing next to the forward end. The oil reservoir can be filled via a filling stub closed by a cap 24. A fuel tank 19 (FIG. 2) is also mounted in the housing 2. The fuel tank 19 lies in the rearward region of the housing and has a fill opening closed with a cap 22. A covering 25 for the mounting end of the guide bar as well as the outlet screen 26 for the engine cooling air and the exhaust-gas outlet are provided at the other longitudinal end (FIG. 3) of the chain saw.

Figure 4:
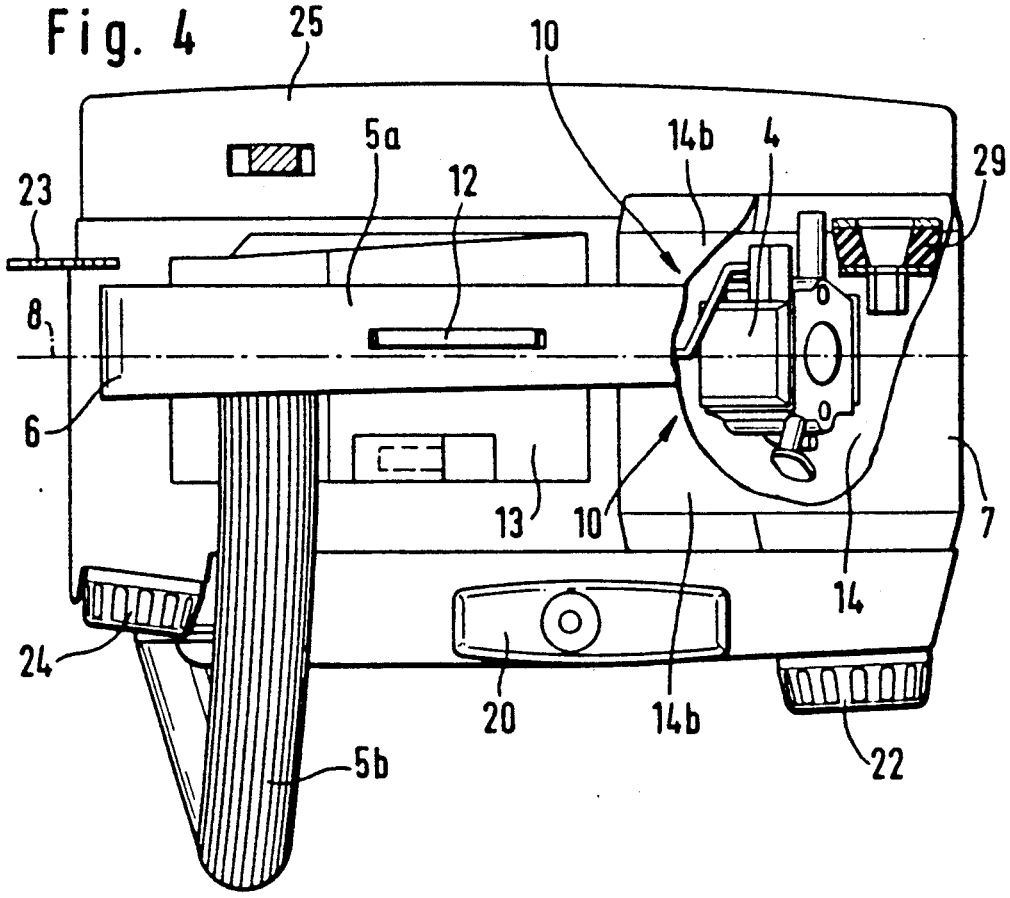
FIG. 4 is a plan view of the work apparatus of FIG. 1.
Figure 5:
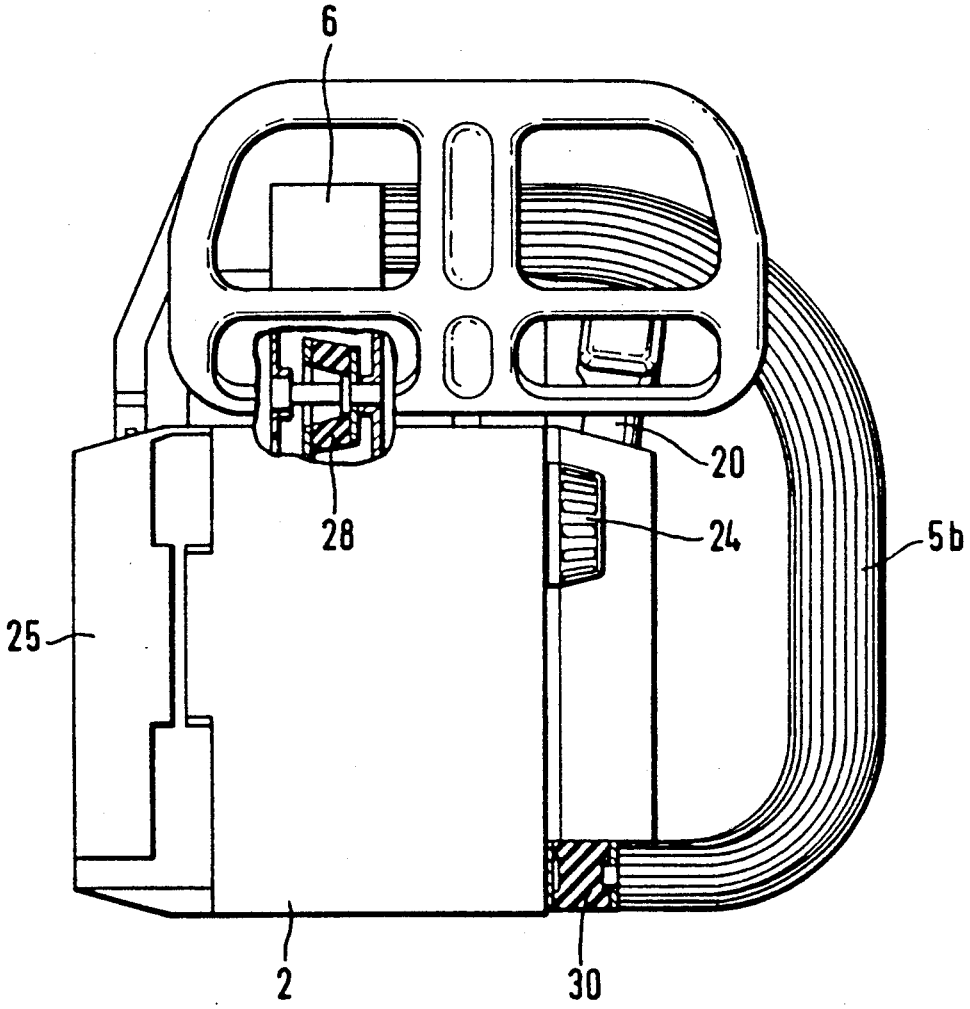
FIG. 5 is a front elevation view of the work apparatus of FIG. 1.

The chain saw is configured as a one-hand work apparatus and correspondingly has a handle unit 5 which is suitable for carrying and guiding the work apparatus with one hand. The handle unit 5 includes a hold portion 5*a* arranged at the top end of the housing 2. As shown in FIG. 4, the hold portion 5*a* is aligned in the direction of the longitudinal axis 8 of the chain saw. The hold portion 5*a* is connected at its forward end to the apparatus housing via an anti-vibration element 28 (FIG. 2) and via an anti-vibration element 29 at its rearward end 7. A bail-type side handle portion is connected at an angle to the hold portion 5*a*. The side handle portion 5*b* is preferably at right angles to the hold portion 5*a* and extends over the side surface of the engine housing having the air-inlet screen down to the lower edge. The side handle portion 5*b* is connected to the engine housing 2 at its lower end via an anti-vibration element 30 (FIG. 5). Preferably, the hold portion 5*a* and the side handle portion 5*b* are configured so as to be a single piece but can also be made of two or more parts.

The hold portion 5*a* is configured so as to expand in a direction transversely to the longitudinal axis 8 (FIG. 4) at its rearward end 7 and forms a receiving chamber 14 in which the carburetor 4 of the engine 3 is mounted. The engine 3 drives a drive sprocket (not shown) via a crankshaft 31 and the saw chain is mounted on the drive sprocket. The crankshaft 31 is driven by piston 17 via a connecting rod 32. The piston 17 and a cylinder 16 conjointly delimit a combustion chamber 15. The cylinder 16 is mounted horizontally and has an intake channel 18 which is mounted so as to face toward the receiving chamber 14. An exhaust-gas channel 33 is arranged in the cylinder 16 at the opposite side of the combustion chamber 15. The exhaust channel 33 opens into a muffler housing 34 having an outlet 27 shown in FIG. 3.

The carburetor 4 is fixedly mounted in the receiving chamber 14 and is connected to the intake channel 18 via an intake stub 35. The end of the connecting stub facing toward the intake channel 18 extends over the end of the intake channel 18. The connecting stub 35 is provided so that a relative movement between the handle unit 5 and the cylinder 16 is possible. The carburetor 4 mounted in the receiving chamber 14 is thereby decoupled from the engine 3 with respect to vibration.

The throttle flap mounted in the carburetor is connected to a throttle linkage 36 which is actuated by a throttle lever 11 pivotally journalled in the hold portion 5*a*. The throttle lever 11 is disposed at the end of the hold portion 5*a* facing toward the housing 2; whereas, a throttle lever latch 12 is disposed in the end of the hold portion 5*a* facing away from the housing 2. The throttle lever latch 12 coacts with the throttle lever 11. Only when the throttle lever latch 12 is depressed, can the throttle lever 11 be pivoted to open the throttle flap.

The hold portion 5*a* of the handle unit 5 is disposed approximately in the longitudinal axis 8 of the work apparatus with the throttle lever 11 being disposed approximately above the gravity center S. The throttle lever 11 is mounted in the hold portion 5*a* and the gravity center S is established when the work tool is connected to the work apparatus. In the case of a chain saw, the work tool is a guide bar having a saw chain mounted thereon.

The receiving chamber 14 is a chamber closed on all sides and is disposed at a spacing (u) from the housing 2. The spacing (u) ensures that the motor housing can vibrate relative to the handle unit 5 within the range of vibrations permitted by the anti-vibration elements 28 to 30. In this way, the handle unit 5 remains substantially at rest.

The slot 37 defined by the spacing (u) simultaneously acts as an inlet gap for the combustion air. For this purpose, air inlet slits are arranged in the wall 14*a* of the receiving chamber facing toward the housing 2.

The receiving chamber 14 comprises a first housing part 38 which is configured as a single piece with the hold portion 5*a* (FIG. 1) and a second housing part 39 which closes the first housing part 38 as a cover. The partition plane 40 between the housing part 38 and the cover 39 extends approximately diagonally through the receiving chamber 14 so that the carburetor 4 is freely accessible for repair and maintenance work after the cover 39 has been removed. In this way, it is especially simple to exchange an air filter since the opening of the housing part 38 is disposed toward the free end of the work apparatus 1.

Figure 3:
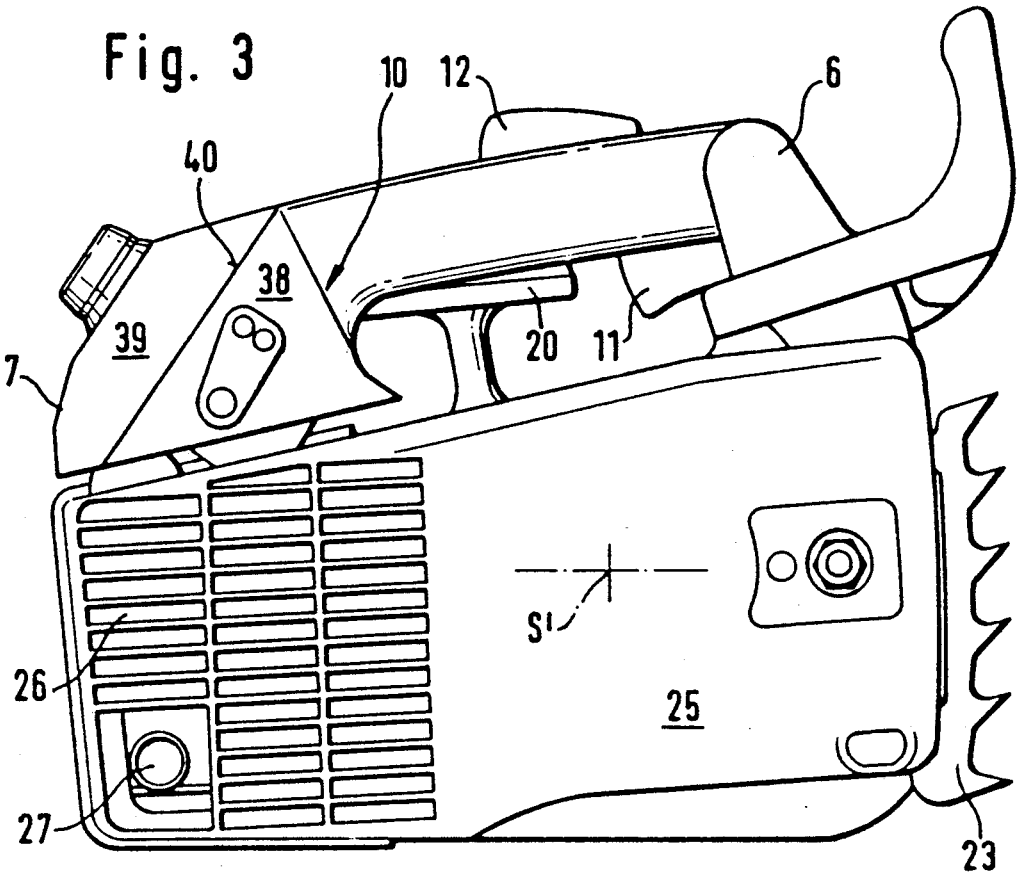
FIG. 3 is a side elevation view of the other side of the work apparatus of FIG. 1.

As shown in FIGS. 1, 3 and 4, the outer wall 4*b* facing toward the hold portion 5*a* is configured as a bearing surface for the heel of the hand of the operator. The operator can safely hold the work apparatus in this manner and can likewise safely compensate for tilt movements about the longitudinal axis 8 with little effort. In the same manner, the operator compensates for tilt movements about the gravity center in the forward and rearward directions.

Figure 2:
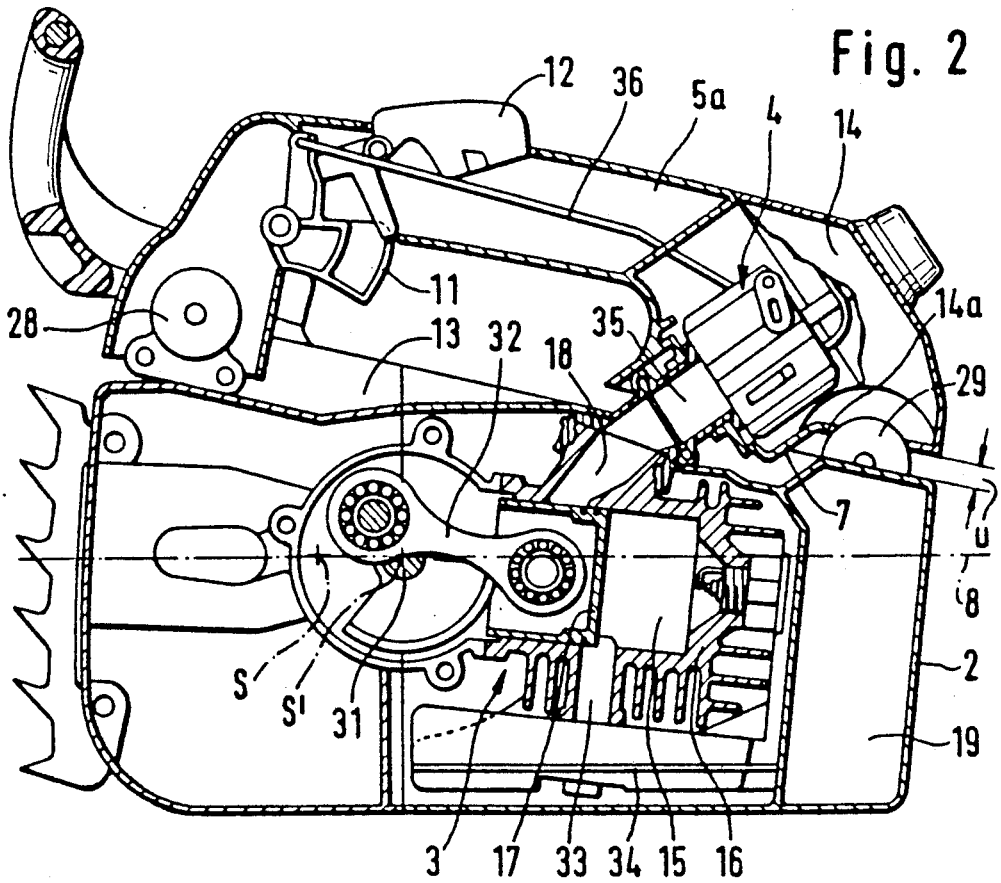
FIG. 2 is a longitudinal section view taken through the work apparatus of FIG. 1.

A handle depression 13 is formed in the housing portion facing toward the hold portion 5*a* in order to place the hold portion 5*a* as close as possible to the gravity center S or S′ as shown in FIG. 2. With this handle depression 13, an adequate spacing of the throttle lever 11 to the housing is provided so that the throttle finger of the operator does not become jammed between the housing and the throttle lever 11.

It is understood that the foregoing description is that of the preferred embodiments of the invention and that various changes and modifications may be made thereto without departing from the spirit and scope of the invention as defined in the appended claims.

What is claimed is:

1. A work apparatus such as a chain saw or the like, the work apparatus being adapted to drive a work tool and to be manipulated by an operator holding the work apparatus with one hand, the work apparatus comprising:

a housing defining a longitudinal axis;

an engine for driving the work tool and being mounted in said housing;

a carburetor for metering an air/fuel-mixture to said engine;

a handle unit for carrying and guiding the work apparatus, said handle unit including: a hold portion having a forward end disposed above said housing so as to extend approximately in the direction of said axis; and, a bail-type side portion extending at an angle from said forward end;

a throttle lever movably journalled in said hold portion;

said hold portion having a rearward end expanded transversely to said axis to form a wall defining a receiving chamber for accommodating said carburetor therein; and, said wall having a first wall portion facing toward said hold portion and said first wall portion being configured to define a bracing support for receiving the heel of the hand of the operator.

2. The work apparatus of claim 1, said wall being configured to enclose said receiving chamber on all sides thereof so as to cause said chamber to be at a spacing (u) from said housing.

3. The work apparatus of claim 2, said wall defining two housing parts conjointly defining a partition plane extending approximately diagonally through said chamber.

4. The work apparatus of claim 3, one of said housing parts being formed integrally with said hold portion and the other one of said housing parts being configured as a removable cover.

5. The work apparatus of claim 2, said wall having a second wall portion disposed so as to face toward said housing; and, said second wall portion having air-inlet slits formed therein for admitting cooling air for cooling said carburetor.

6. The work apparatus of claim 1, said work apparatus having a predetermined center of gravity (S) when the work tool is mounted thereon; and, said throttle lever being mounted in said hold portion so as to be disposed approximately above said center of gravity (S).

7. The work apparatus of claim 1, said housing having an upper wall facing toward said hold portion; and, said upper wall having a depression formed therein for providing a clearance spacing for accommodating the throttle finger of the hand of an operator.

* * * * *